United States Patent [19]

Eckhardt et al.

[11] Patent Number: 5,035,825

[45] Date of Patent: Jul. 30, 1991

[54] STABLE BLEACHING DETERGENTS CONTAINING STILBENE FLUORESCENT WHITENING AGENTS

[75] Inventors: Claude Eckhardt, Riedisheim, France; Heinz Hefti, Reinach, Switzerland; Hans R. Meyer, Binningen, Switzerland; Kurt Weber, Basel, Switzerland

[73] Assignee: Ciba-Geigy Corporation, Ardsley, N.Y.

[21] Appl. No.: 526,870

[22] Filed: May 22, 1990

Related U.S. Application Data

[63] Continuation-in-part of Ser. No. 275,241, Nov. 22, 1988, abandoned, and a continuation-in-part of Ser. No. 275,237, Nov. 22, 1988, abandoned.

[30] Foreign Application Priority Data

Nov. 26, 1987 [CH] Switzerland ..... 4599/87
Dec. 23, 1987 [CH] Switzerland ..... 5009/87

[51] Int. Cl.[5] ..... C11D 7/18; C11D 7/38; C11D 7/54; C11D 7/60

[52] U.S. Cl. ..... 252/95; 252/99; 252/186.38; 252/186.42; 252/186.43; 252/186.44; 252/301.21; 252/301.27; 252/301.28; 252/301.32; 252/543; 252/549

[58] Field of Search ..... 252/301.21, 301.27, 252/301.28, 301.32, 543, 549, 186.38, 186.42, 186.43, 186.44, 95, 99

[56] References Cited

U.S. PATENT DOCUMENTS

| | | | |
|---|---|---|---|
| 3,133,916 | 5/1964 | Duennenberger et al. | 252/543 |
| 3,449,333 | 6/1969 | Dorlars et al. | 252/543 |
| 3,642,783 | 2/1972 | Siegrist et al. | 252/301.21 |
| 3,741,903 | 6/1973 | Evans et al. | 252/95 |
| 3,779,931 | 12/1973 | Fries et al. | 252/99 |
| 4,123,376 | 10/1978 | Gray | 252/99 |
| 4,329,245 | 5/1982 | Eymond et al. | 252/102 |
| 4,430,243 | 2/1984 | Bragg | 252/91 |
| 4,578,206 | 3/1986 | Walker | 252/95 |
| 4,579,678 | 4/1986 | Walker | 252/95 |
| 4,680,131 | 7/1987 | Busch et al. | 252/102 |

FOREIGN PATENT DOCUMENTS

| | | |
|---|---|---|
| 0145438 | 6/1985 | European Pat. Off. . |
| 0612817 | 2/1980 | Switzerland . |
| 1269677 | 4/1972 | United Kingdom . |

OTHER PUBLICATIONS

CA 91:125252u, "Bleaching Compositions Containing Per-Compounds & . . . ", H. Bloching, 1979.

JAOCS, vol. #65, #4 (1988), W. R. Findley, pp. 679-683.

*Primary Examiner*—Paul Lieberman
*Assistant Examiner*—A. Beadles-Hay
*Attorney, Agent, or Firm*—George R. Dohmann; Edward McC. Roberts

[57] ABSTRACT

Detergents which, in addition to inorganic and/or organic peracids, contain specific stilbene compounds as fluorescent whitening agents. These detergents are stable for several months and already show the customary cleaning properties at washing temperatures of 20°-60° C.

12 Claims, No Drawings

STABLE BLEACHING DETERGENTS CONTAINING STILBENE FLUORESCENT WHITENING AGENTS

This is a continuation in part of Ser. No. 275,241 filed Nov. 22, 1988 and Ser. No. 275,237 filed Nov. 22, 1988 both now abandoned.

The Application relates to storage-stable detergents which, in addition to at least one peracid or salts thereof, contain at least one specific fluorescent whitening agent of the stilbene type, and to their preparation and use for washing textiles.

Because of the increased content of synthetic fibres and fibre blends in the textiles manufactured today and the desire no longer to have to wash coloured laundry separately and for energy saving measures, in many countries laundry is no longer washed at 90° C.-95° C. or at the boil but at lower temperatures. This means that it has been necessary for the perborates which have usually so far been contained in detergents and act as bleaching agents to be activated by auxiliaries, such as tetraacetylethylenediamine (TAED) in order to achieve acceptable bleaching effects even at washing temperatures of 60°-80° C. At still lower washing temperatures, even the perborate/activator systems no longer give satisfactory results.

Detergents which contain stronger bleaching agents, for example peracids, have therefore been described for some time (German Offenlegungsschrift 2,756,583, EP-A-145,438, GB 2,141,754, GB 2,151,755, U.S. Pat. No. 4,028,263 and GB 59,272). Although these novel bleaching agents on the one hand already exhibit outstanding bleaching effects at temperatures from 20° C., on the other hand they destroy the customary fluorescent whitening agents contained in detergents.

It has now been found that specific stilbene compounds surprising have an excellent stability in detergents which contain such strong bleaching agents. Under average storage conditions and even under intensified conditions (temperature above 30° C. and atmospheric humidity above 60%), these specific stilbene fluorescent whitening agents are completely stable, or are at most degraded to a degree which causes no trouble in practice, in the detergent for several months.

The Application thus relates to storage-stable detergents containing 0.5 to 30% of an inorganic or organic peracid or salts thereof or mixtures of peracids or salts thereof and 0.03% to 0.5% of a fluorescent whitening agent or a mixture of fluorescent whitening agents wherein the fluorescent whitening agents are stilbene fluorescent whitening agents of the formula (I)

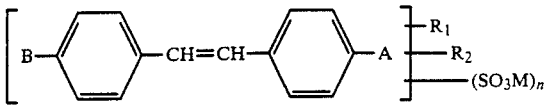

(I)

in which A is hydrogen, —$SO_3M$, halogen, phenyl or phenylpyrazol-1-yl; B is benzofuran-2-yl if A is hydrogen, 2-(stilben-4-yl)oxadiazol-5-yl if A is halogen, phenylpyrazol-1-yl if A is phenylpyrazol-1-yl, benzoxazol-2-yl if A is —$SO_3M$ or phenyl, or naphthoxazol-2-yl if A is hydrogen; $R_1$ and $R_2$ independently of one another are hydrogen, halogen, $C_1$-$C_4$-alkyl or $C_1$-$C_4$-alkoxy; M is hydrogen or one equivalent of a non-chromophoric cation and n is zero to 2, but the compound of formula (I) contains at least one —$SO_3M$ group.

M in formula (I) is, for example, an alkaline earth metal, such as magnesium or calcium, but preferably an alkali metal, such as lithium, sodium or potassium, or substituted or unsubstituted ammonium, such as ammonium, mono-, di- or triethanol-ammonium, mono-, di- or tripropanolammonium or tri- or tetramethylammonium.

In particular, the detergents contain as fluorescent whitening agents compounds of the formulae

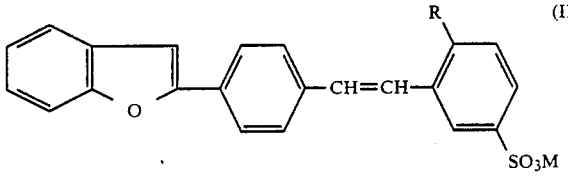

(II)

in which R is H or halogen and M is as defined above,

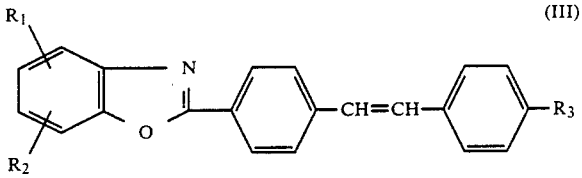

(III)

in which $R_1$ and $R_2$ are H or $C_1$-$C_4$-alkyl, $R_3$ is —$SO_3M$ or

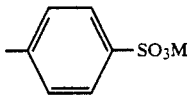

and M is as defined above,

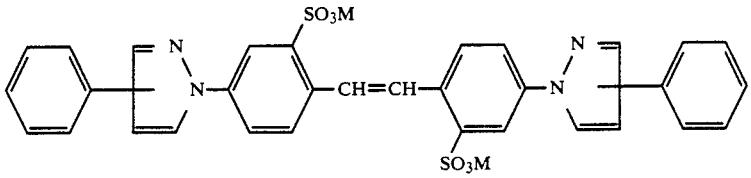

(IV)

in which M is as defined above, and/or

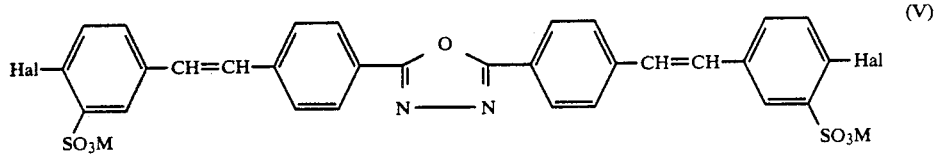

(V)

in which M is as defined above.

All these fluorescent whitening agents of the formulae I to V are known and can be prepared by know methods.

The peracids or salts thereof are inorganic or organic compounds which are described in the literature or are commercially available and which already bleach textiles at temperatures from 20° C. The organic peracids, for example mono- or polyperacids having alkyl chains of at least 3, preferably 6 to 20, carbon atoms, but in particular diperoxydicarboxylic acids having 6 to 12 carbon atoms, such as diperoxyazelaic acid, diperoxysebacic acid and/or diperoxyphthalic acid, are of particular interest. The preferred organic peracid is diperoxydodecanedioic acid (DPDDA). However, it is also possible for highly active inorganic peracids, such as persulfate and/or percarbonate, to be used. The amount of organic peracids to be used is preferably 0.5% to 10%, in particular 1% to 5%, and the amount of inorganic peracids to be used is preferably 1% to 30%, in particular 10% to 20%, based on the total weight of detergent, and if appropriate in combination with small amounts of compounds which intensify the bleaching action of the peracids. For example small amounts of catalytically acting divalent metal salts, such as are described in U.S. Pat. No. 4,655,782 and U.S. Pat. No. 4,655,953. Metal salts of copper and/or manganese are preferably used.

Mixtures of organic and/or inorganic peracids or peracid salts can of course also be used.

The peracids are added to the detergent by dry mixing the components, for example with the aid of automatic screw metering systems and/or fluidized bed mixers.

The detergents are dry detergents of customary compositions. As a rule, in addition to the combination according to the invention of peracid and fluorescent whitening agent, they contain, for example, anionic, nonionic, amphoteric and/or cationic surfactants, builders, for example pentasodium tripolyphosphate or substitute products, such as phosphonates, polycarboxylates, acrylic/maleic copolymers, zeolites, nitrilotriacetate and ethylenediaminetetraacetic acid, soil-suspending agents, for example sodium carboxymethylcellulose, salts for adjusting the pH, for example alkali metal or alkaline earth metal silicates, foam regulators, for example soaps, salts for adjusting the spray-drying and granulation properties, for example sodium sulfate, perfumes and if appropriate antistatic and softening agents, enzymes, photobleaching agents, pigments and/or toning agents. These constituents should of course be stable towards the bleaching system used.

As a result of the combination according to the invention, it is possible to provide detergents which meet the customary standard, for example as regards to washing power, spot removal and refreshing the appearance of the washed articles, even if washing is carried out at temperatures of 20° C.-60° C. Coloured laundry and white laundry can thus advantageously be washed together regardless of the fibre.

The following examples illustrate the invention without limiting it thereto. Percentage data are percentages by weight.

EXAMPLE 1

Detergent Formulation

The detergents of the following examples are prepared in two stages by customary processes:

Granules A are first prepared by drying and granulating a slurry consisting of about 1 part of water and 1 part of detergent of the following composition:

84 g of linear dodecylbenzenesulfonate
31 g of tallow alcohol tetradecane-ethylene glycol ether (14 mol of ethyleneoxide)
37 g of Na soap (chiefly of behenic acid and $C_{14}$–$C_{20}$)
458 g of Na tripolyphosphate
79 g of Na silicate
20 g of Mg silicate
12 g of carboxymethylcellulose
2 g of ethylenediamine tetraacetate
222 g Na sulfate
1 g of fluorescent whitening agent (FWA) according to the formula (II)-(V).

The peracid B (70 g of K monopersulfate+2 mg of anhydrous $CuSO_4$) is homogeneously admixed in the dry state to 500 g of these granules A, which have a residual moisture content of 5% after drying.

Storage Test

Samples of the detergent D (granules A+peracid B) thus obtained are:

on the one hand, for control of the starting value, immediately analyzed for the content of FWA by extraction and measurement of the spectrophotometric absorbance (theoretical: 0.1% of FWA, based on the weight of the granules A), on the other hand kept in cardboard packets suitable for commercial washing powder, that is to say with a coating, under selected and controlled conditions of temperature and atmospheric humidity for certain periods of time. After storage, the FWA content of each detergent is immediately determined. The difference from the starting value is expressed as a percentage and is a measure of the stability of the FWA towards the corresponding bleaching agent in the washing powder.

The abovementioned FWA determination is carried out as follows:

The washing powder is homogenized thoroughly by grinding and 1 g thereof is admixed with 200 ml of solvent consisting of 9 parts of dimethyl sulfoxide and 1 part of water, and the mixture is stirred at room temperature for 30 minutes. It is then centrifuged for 30 minutes. A sample of the clear solution thus obtained is transferred with a pipette into a 1 cm quartz cell and its absorbance is measured in the UV range at the absorption maximum against a standard solution of the particular FWA. The absorbance is proportional to the FWA concentration. The reproducibility of the results is about ±1% if the test conditions are kept exactly the same.

Result

The percentage FWA loss is determined under the conditions described above. Storage is in a closed packet at 20° to 25° C. After 6 months, the FWA loss is as follows:

EXAMPLE 2

Detergent Formulation

The detergents of the following examples are prepared in two stages by customary processes:

Granules A are first prepared by drying and granulating a slurry consisting of about 1 part of water and 1 part of detergent of the following composition:

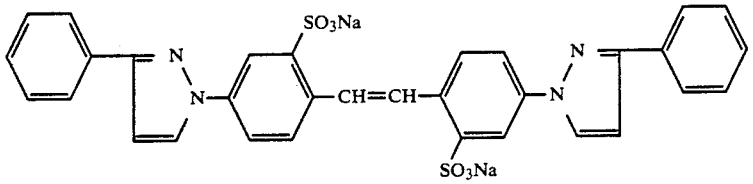

0%

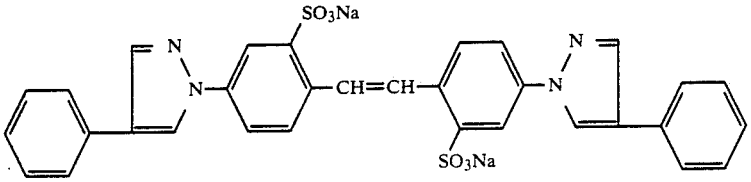

0%

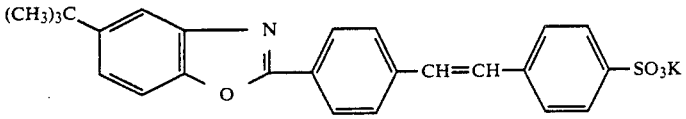

0%

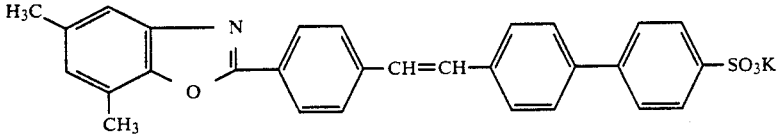

0%

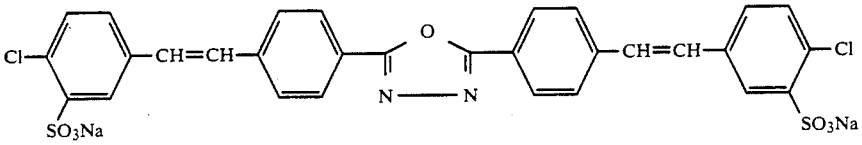

1%

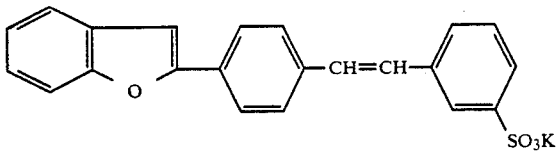

3%

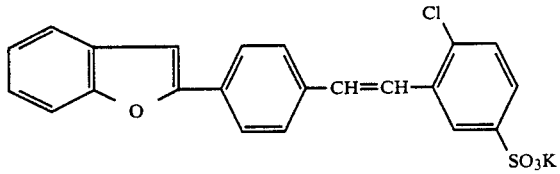

3%

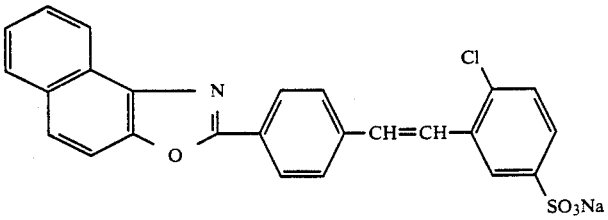

0%

84 g of linear dodecylbenzenesulfonate
31 g of tallow alcohol tetradecane-ethylene glycol ether (14 mol of ethyleneoxide)
37 g of Na soap (chiefly of behenic acid and $C_{14}$–$C_{20}$)
458 g of Na tripolyphosphate
79 g of Na silicate
20 g of Mg silicate
12 g of carboxymethylcellulose
2 g of ethylenediamine tetraacetate
222 g Na sulfate
1 g of fluorescent whitening agent (FWA) according to the formula (II)–(V).

The peracid B (15 g of DPDDA) is homogeneously admixed in the dry state to 500 g of these granules A, which have a residual moisture content of 5% after drying.

Storage Test

The storage test is carried out as in Example 1.

Result

The percentage FWA loss is determined under the conditions described above. Storage is in a closed packet at 20° to 25° C. After 6 months, the FWA loss is as follows:

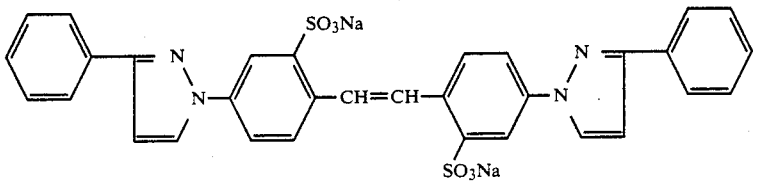

2%

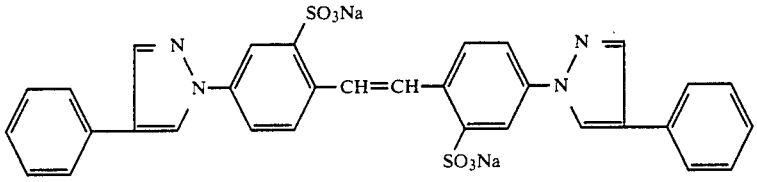

3%

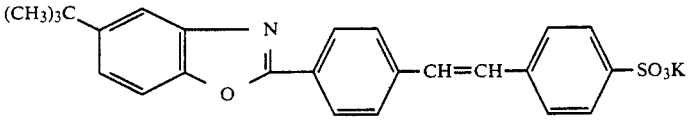

1%

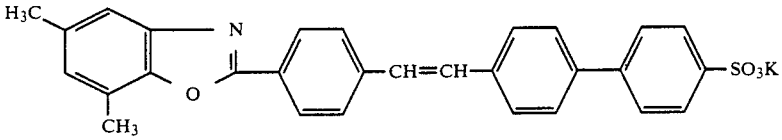

1%

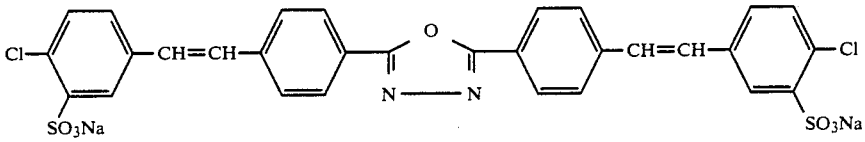

1%

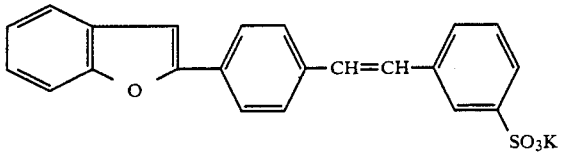

3%

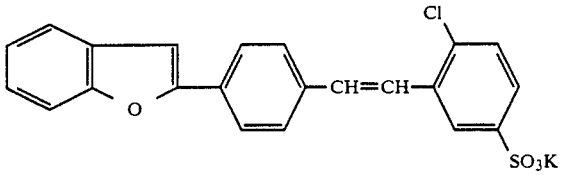

2%

-continued

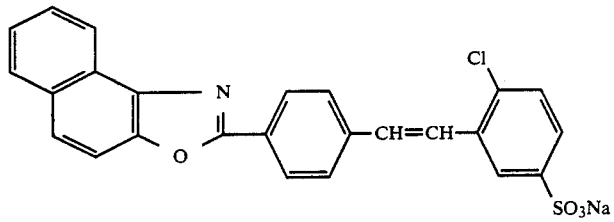

0%

What is claimed is:

1. A storage-stable detergent containing 0.5 to 30% of an inorganic or organic peracid or salts thereof or mixtures of peracids or salts thereof, said peracid being capable of bleaching textiles at 20° C., and 0.03% to 0.5% of a fluorescent whitening agent or a mixture of fluorescent whitening agents wherein the fluorescent whitening agents are stilbene fluorescent whitening agents of the formula (I)

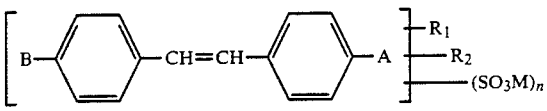

(I)

in which A is hydrogen, —$SO_3M$, halogen, phenyl or phenylpyrazol-1-yl; B is benzofuran-2-yl if A is hydrogen, 2-(stilben-4-yl)oxadiazol-5-yl if A is halogen, phenylpyrazol-1-yl if A is phenylpyrazol-1-yl, benzoxazol-2-yl if A is —$SO_3M$ or phenyl, or naphthoxazol-2-yl if A is hydrogen; $R_1$ and $R_2$ independently of one another are hydrogen, halogen, $C_1$–$C_4$-alkyl or $C_1$–$C_4$-alkoxy; M is hydrogen or one equivalent of a non-chromophoric cation and n is zero to 2, but the compound of formula (I) contains at least one —$SO_3M$ group.

2. A detergent according to claim 1, which contains peracids or salts thereof which bleach textile material at a temperature from 20° C.

3. A detergent according to claim 1, which contains, as the peracid or peracid salt, a diperoxydicarboxylic acid having 6 to 20 carbon atoms, a persulfate and/or a percarbonate.

4. A detergent according to claim 3, which contains as the peracid or peracid salt, a diperoxydicarboxylic acid having 6–12 carbon atoms.

5. A detergent according to claim 3 which further contains small amounts of compounds which intensify the bleaching action of the peracids.

6. A detergent according to claim 1, which contains as the organic peracid diperoxydodecanedioic acid.

7. A detergent according to claim 1, which contains, as the fluorescent whitening agent, a compound of the formula (II)

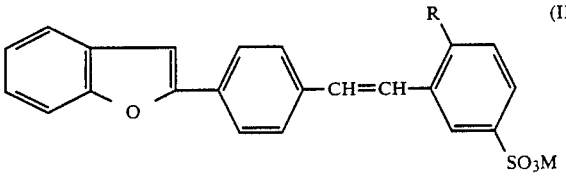

(II)

in which R is H or halogen.

8. A detergent according to claim 1, which contains, as the fluorescent whitening agent, a compound of the formula (III)

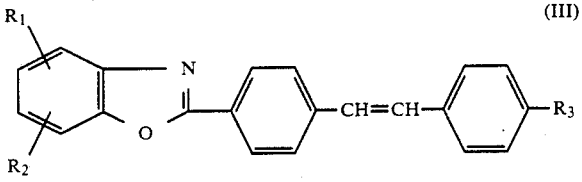

(III)

in which $R_1$ and $R_2$ are H or $C_1$–$C_4$-alkyl, $R_3$ is —$SO_3M$ or

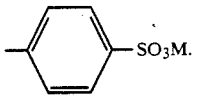

9. A detergent according to claim 1, which contains, as the fluorescent whitening agent, a compound of the formula (IV)

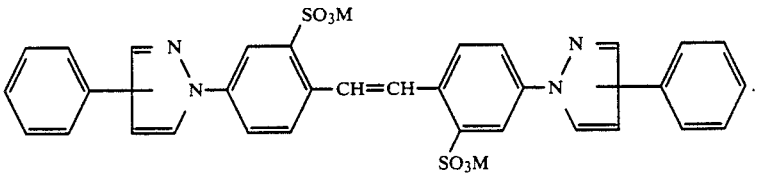

(IV)

10. A detergent according to claim 1, which contains, as the fluorescent whitening agent, a compound of the formula (V)

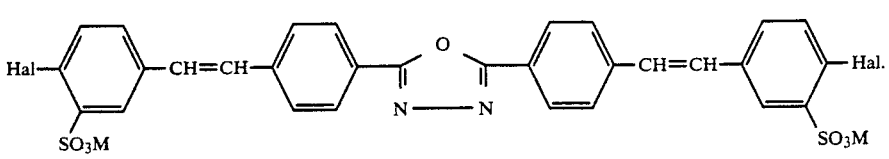
(V)
11. A method of washing textiles which comprises the step of washing said textiles in a detergent according to claim 1 at temperatures of 20°-60° C.
12. The preparation of a detergent according to claim 1 by dry mixing the components with the aid of automatic screw metering systems and/or fluidized bed mixers.
* * * * *